US010181666B2

(12) United States Patent
Hirasawa

(10) Patent No.: US 10,181,666 B2
(45) Date of Patent: Jan. 15, 2019

(54) TERMINAL HOLDING STRUCTURE AND MOLDED ARTICLE

(71) Applicant: Yazaki Corporation, Tokyo (JP)

(72) Inventor: Hitoshi Hirasawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/698,017

(22) Filed: Sep. 7, 2017

(65) Prior Publication Data

US 2018/0097306 A1 Apr. 5, 2018

(30) Foreign Application Priority Data

Sep. 30, 2016 (JP) ..... 2016-194036

(51) Int. Cl.

| | |
|---|---|
| ***H01R 4/38*** | (2006.01) |
| ***H01R 13/115*** | (2006.01) |
| ***H01R 11/12*** | (2006.01) |
| ***H01R 13/422*** | (2006.01) |
| *H01R 9/18* | (2006.01) |

(52) U.S. Cl.

CPC ..... *H01R 13/115* (2013.01); *H01R 11/12* (2013.01); *H01R 13/4223* (2013.01); *H01R 9/18* (2013.01); *H01R 2201/26* (2013.01)

(58) Field of Classification Search

CPC ... H01R 4/34; H01R 4/32; H01R 4/30; H01R 11/12; H01R 11/283; H01R 4/64; H01R 4/185

USPC ..... 439/766, 883, 781, 97

See application file for complete search history.

(56) References Cited

U.S. PATENT DOCUMENTS

| | | | | |
|---|---|---|---|---|
| 5,997,341 | A * | 12/1999 | Ushiyama | H01R 4/305 439/480 |
| 7,731,520 | B1 * | 6/2010 | Daily | H01R 24/84 439/357 |
| 8,870,610 | B2 * | 10/2014 | Tsuji | H01R 4/029 439/874 |
| 9,184,516 | B2 * | 11/2015 | Nobukuni | H01R 4/64 |
| 9,257,759 | B2 * | 2/2016 | Nobukuni | H01R 4/305 |
| 9,337,557 | B2 * | 5/2016 | Sakamoto | H01R 13/4223 |
| 9,490,598 | B2 * | 11/2016 | Onoda | H01R 4/48 |
| 9,692,148 | B2 * | 6/2017 | Uehara | H01R 4/185 |

(Continued)

FOREIGN PATENT DOCUMENTS

| | | |
|---|---|---|
| JP | 7-263043 A | 10/1995 |
| JP | 2000-168469 A | 6/2000 |

(Continued)

*Primary Examiner* — Hae Moon Hyeon

(74) *Attorney, Agent, or Firm* — Kenealy Vaidya LLP

(57) ABSTRACT

A terminal holding structure includes a fixing wall portion configured to be fixed, together with a grounding terminal, to a fixing target part by a fixing member; a flexible arm portion that is connected, at a proximal end thereof, to the fixing wall portion, and extends in a direction along a wall surface of the fixing wall portion, and that is configured to lock a locking portion provided at a distal end portion of the grounding terminal; and a supporting portion that forms, in conjunction with the arm portion, a passage into which the grounding terminal is inserted by being slid thereon along the arm portion, and that is configured to support the grounding terminal from a side thereof opposite to the arm portion side in a state where the arm portion locks the locking portion.

9 Claims, 11 Drawing Sheets

(56) References Cited

U.S. PATENT DOCUMENTS

| | | | | |
|---|---|---|---|---|
| 9,793,627 | B2 * | 10/2017 | Omori | H01R 4/64 |
| 2008/0194126 | A1 * | 8/2008 | Grant | H01R 11/12<br>439/108 |
| 2015/0333462 | A1 * | 11/2015 | Onoda | H01R 4/48<br>439/121 |
| 2017/0229796 | A1 * | 8/2017 | Kitagawa | H01R 4/64 |

FOREIGN PATENT DOCUMENTS

| | | | |
|---|---|---|---|
| JP | 2001-176574 | A | 6/2001 |
| JP | 2011-65894 | A | 3/2011 |

* cited by examiner

TERMINAL HOLDING STRUCTURE AND MOLDED ARTICLE

CROSS-REFERENCE TO RELATED APPLICATION(S)

The present application claims priority to and incorporates by reference the entire contents of Japanese Patent Application No. 2016-194036 filed in Japan on Sep. 30, 2016.

BACKGROUND OF THE INVENTION

1. Field of the Invention

The present invention relates to a terminal holding structure and a molded article.

2. Description of the Related Art

Existing technologies are present for fixing grounding terminals to a molded article, such as a protector. Japanese Patent Application Laid-open No. 2011-65894 discloses a technology of a fixing structure of grounding terminals in which a fixing base is provided, in a recessed manner, with a terminal accommodating recess for fitting therein a first grounding terminal, and is provided, in a projecting manner, with electric contact portion guide projections for positioning and holding an electric contact portion of a second grounding terminal and an electric wire crimping portion guide projection for positioning and holding an electric wire crimping portion of the second grounding terminal.

The holding performance is desired to be improved so that the grounding terminals thus retained will not easily come off. To improve the holding performance, it is conceivable to increase the stiffness of holding members, such as the guide projections disclosed in Japanese Patent Application Laid-open No. 2011-65894. Increasing the stiffness of the holding members, however, increases the force required for deforming the holding members to make the grounding terminals retained, and leads to deterioration in workability.

SUMMARY OF THE INVENTION

It is an object of the present invention to provide a terminal holding structure and a molded article that are capable of both improving the holding performance and improving the workability in making a grounding terminal retained.

A terminal holding structure according to one aspect of the present invention includes a fixing wall portion configured to be fixed, together with a grounding terminal, to a fixing target part by a fixing member; a flexible arm portion that is connected, at a proximal end thereof, to the fixing wall portion, and extends in a direction along a wall surface of the fixing wall portion, and that is configured to lock a locking portion provided at a distal end portion of the grounding terminal; and a supporting portion that forms, in conjunction with the arm portion, a passage into which the grounding terminal is inserted by being slid thereon along the arm portion, and that is configured to support the grounding terminal from a side thereof opposite to the arm portion side in a state where the arm portion locks the locking portion.

According to another aspect of the present invention, in the terminal holding structure, it is preferable that the arm portion includes a flexible arm body, and a locking projection that projects from the arm body toward a side of the supporting portion and that is configured to lock the locking portion, and the locking projection projects into a passing region of the grounding terminal inserted into the passage.

According to still another aspect of the present invention, it is preferable that the terminal holding structure further includes a pair of side walls that project from the wall surface of the fixing wall portion, and that face each other in a width direction of the arm portion across the arm portion, wherein the supporting portion projects from one of the side walls toward the other of the side walls.

A molded article according to still another aspect of the present invention includes a main body configured to be mounted on a wire harness; a fixing wall portion that is molded integrally with the main body, and that is configured to be fixed, together with a grounding terminal of the wire harness, to a fixing target part by a fixing member; a flexible arm portion that is connected, at a proximal end thereof, to the fixing wall portion, and extends in a direction along a wall surface of the fixing wall portion, and that is configured to lock a locking portion provided at a distal end portion of the grounding terminal; and a supporting portion that forms, in conjunction with the arm portion, a passage into which the grounding terminal is inserted by being slid thereon along the arm portion, and that is configured to support the grounding terminal from a side thereof opposite to the arm portion side in a state where the arm portion locks the locking portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

The following describes in detail a terminal holding structure and a molded article according to an embodiment of the present invention, with reference to the drawings. The embodiment does not limit the present invention. Components in the following embodiment include those easily conceivable by those skilled in the art, and those substantially the same.

Embodiment

Figure 1:
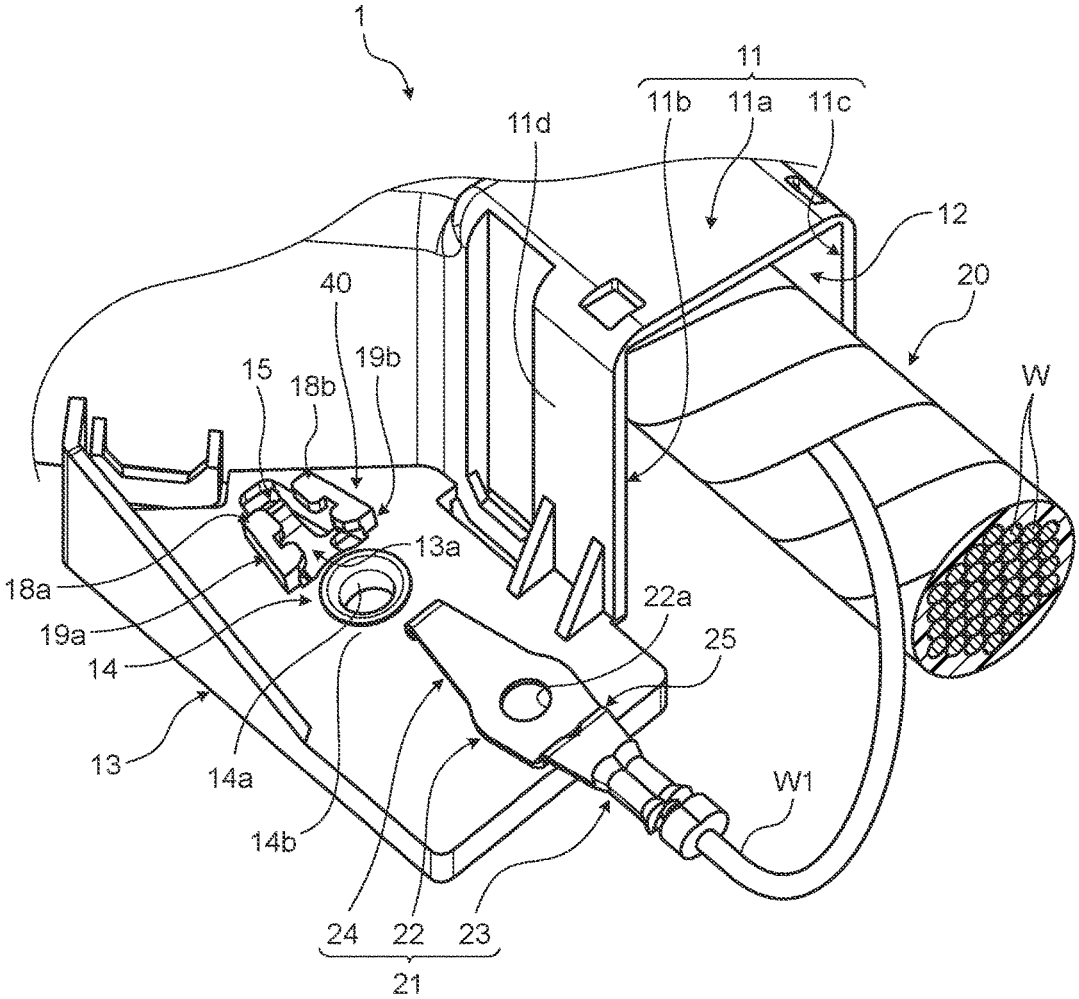
FIG. 1 is a perspective view of a terminal holding structure and a protector according to an embodiment of the present invention.
Figure 2:
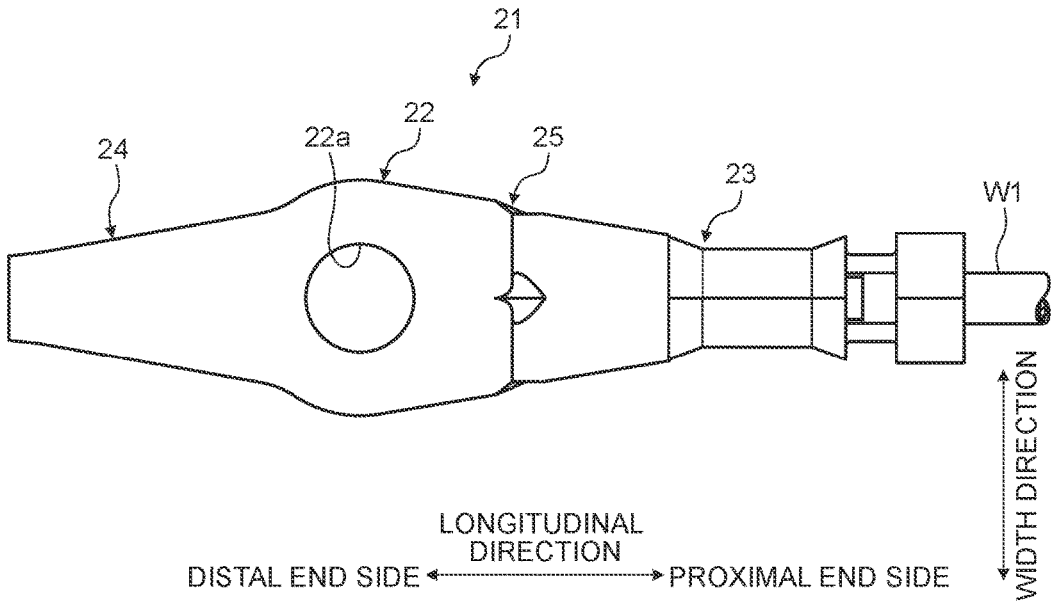
FIG. 2 is a plan view of a grounding terminal according to the embodiment.
Figure 3:
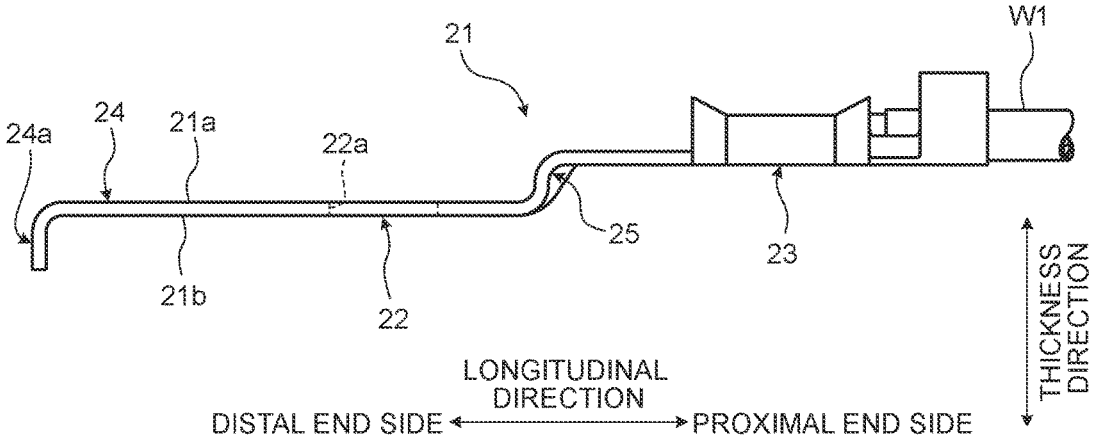
FIG. 3 is a side view of the grounding terminal according to the embodiment.
Figure 4:
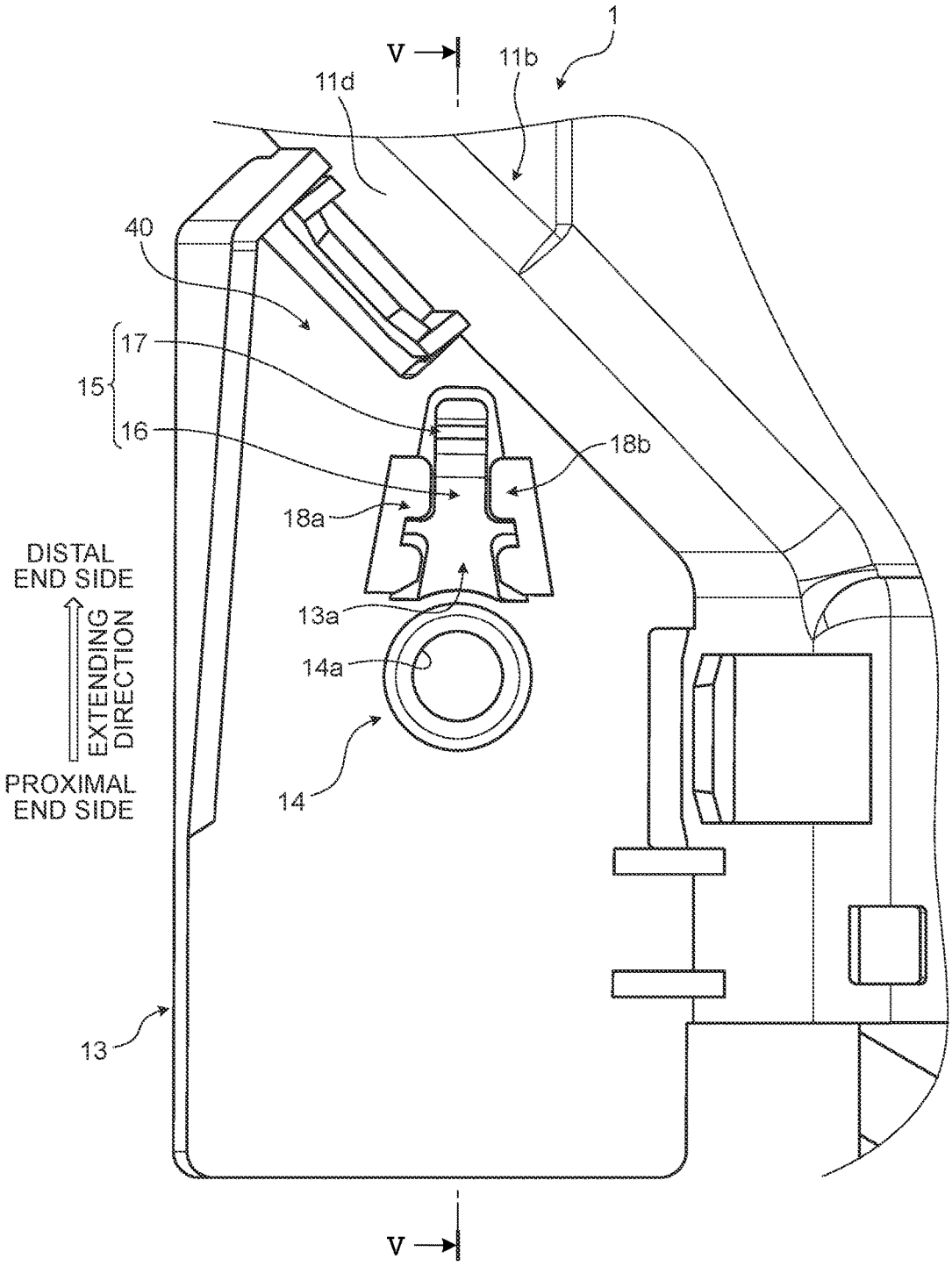
FIG. 4 is a plan view of the terminal holding structure and the protector according to the embodiment.
Figure 5:
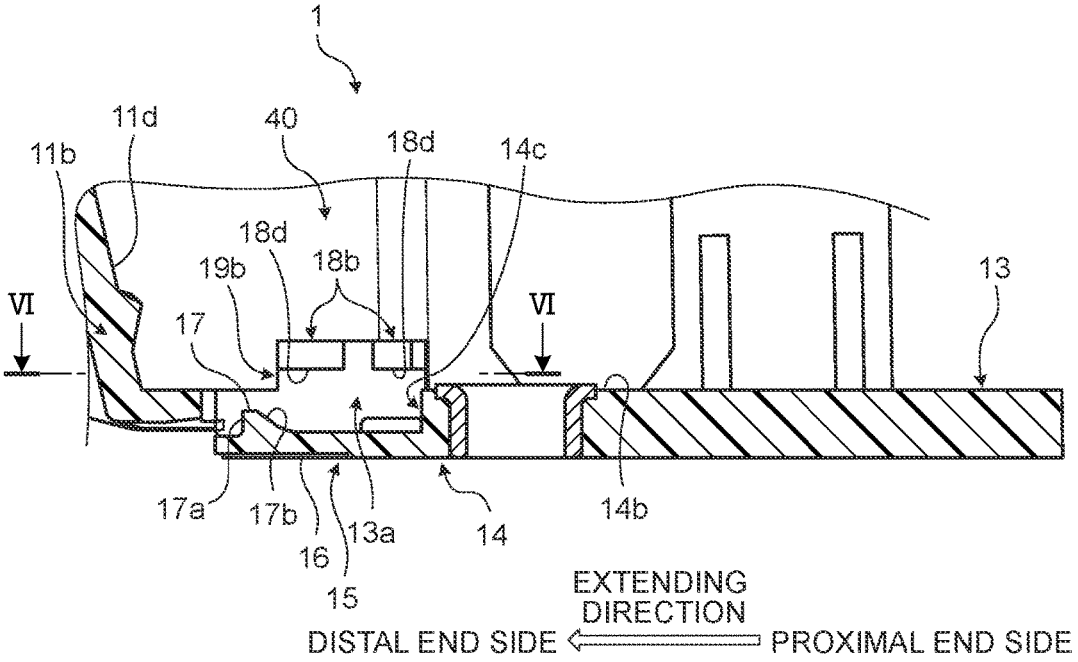
FIG. 5 is a sectional view of the terminal holding structure according to the embodiment.
Figure 6:
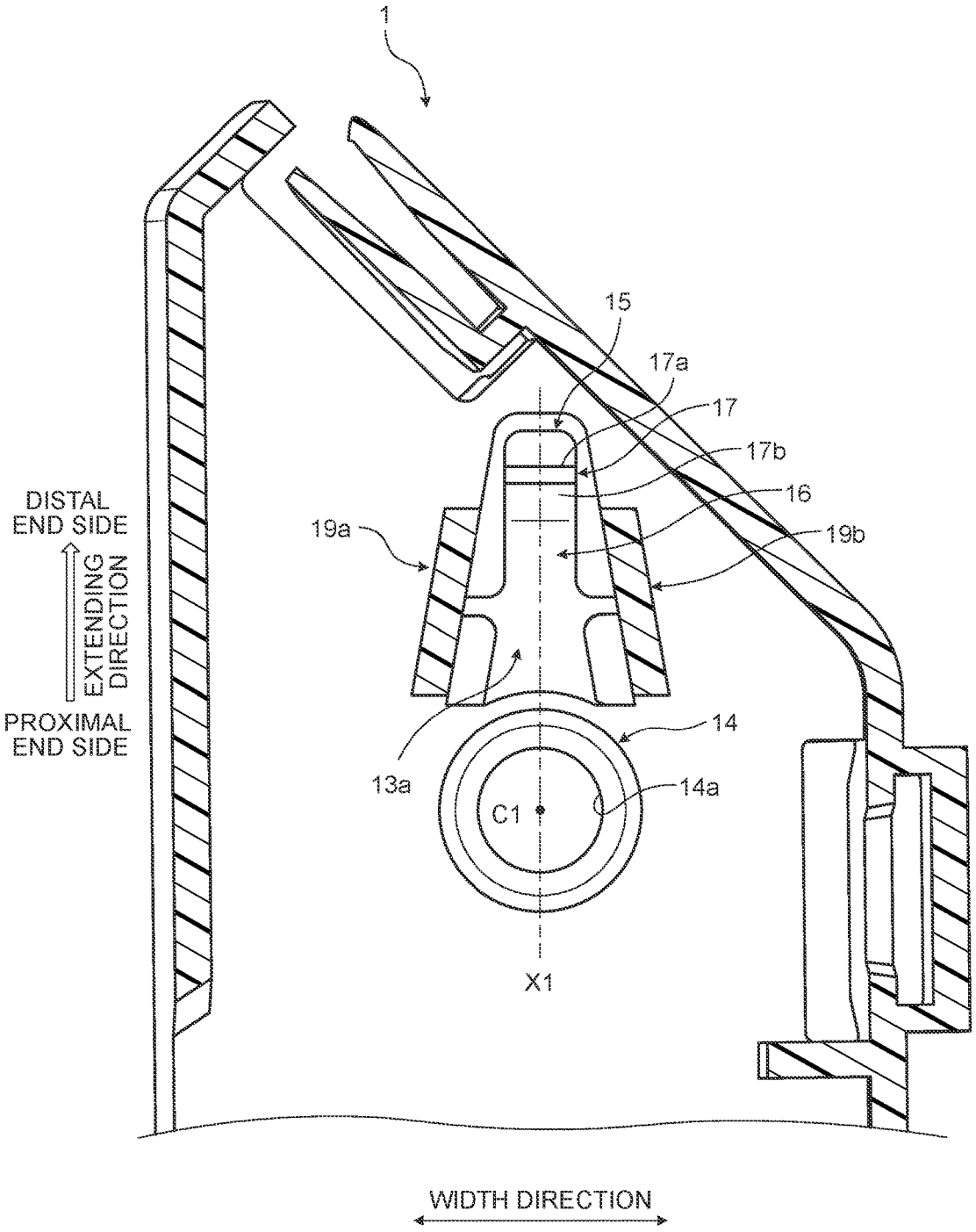
FIG. 6 is a sectional view of side walls according to the embodiment.
Figure 7:
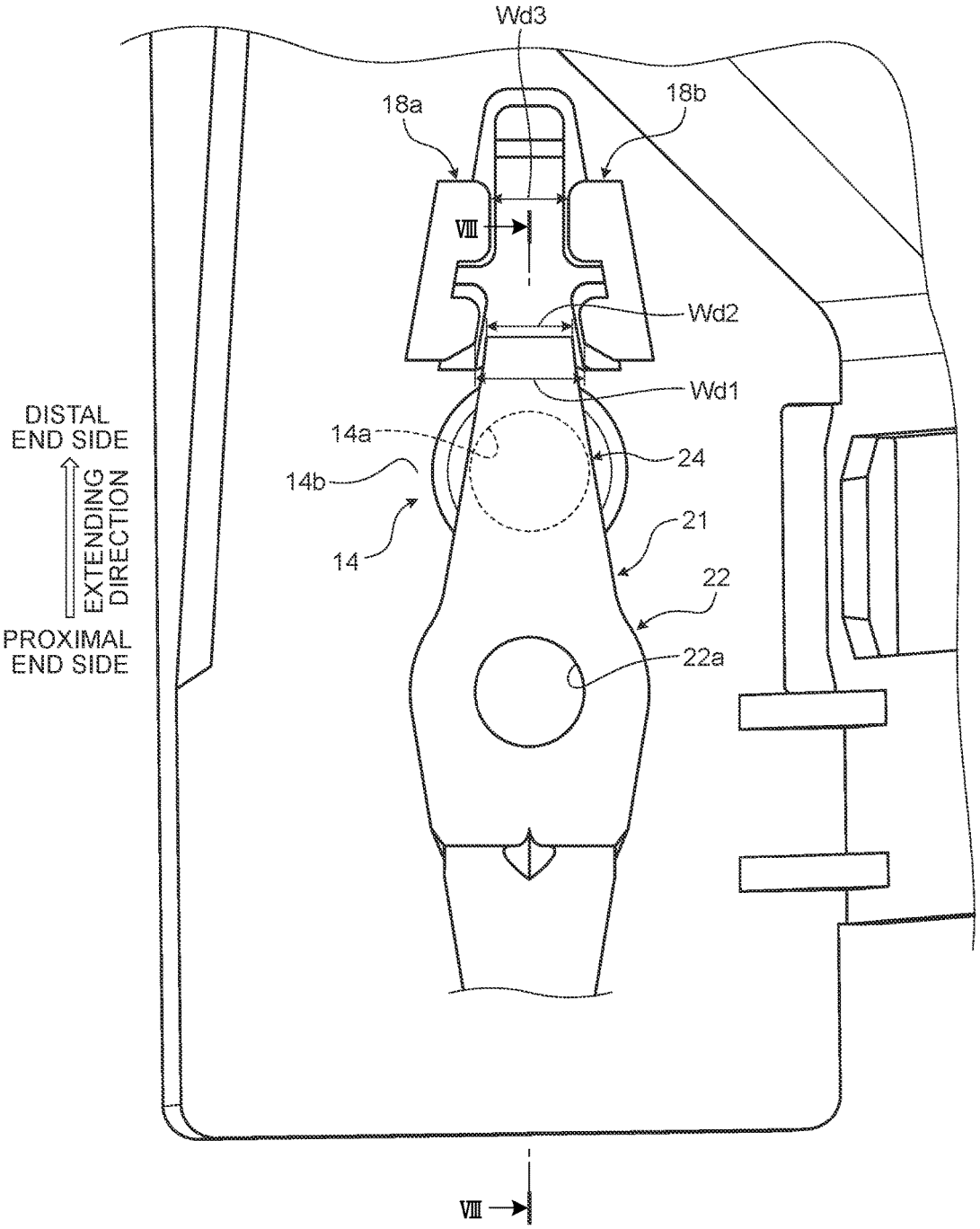
FIG. 7 is a plan view for explaining supporting portions according to the embodiment.
Figure 8:
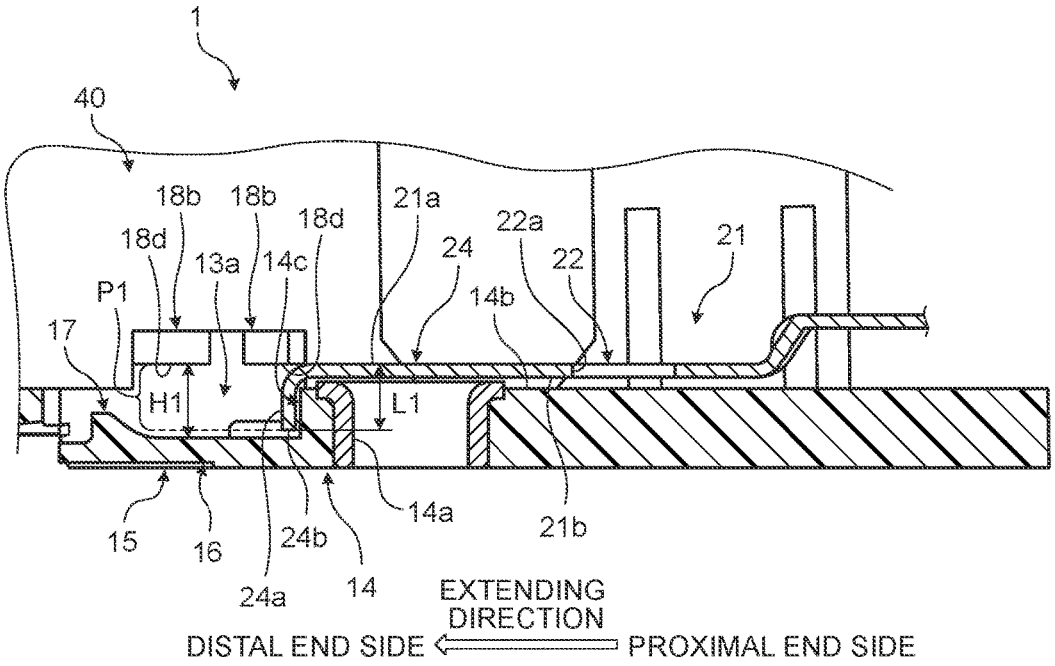
FIG. 8 is a sectional view illustrating the grounding terminal at start of insertion.

The embodiment will be described with reference to FIGS. 1 to 13. The present embodiment relates to the terminal holding structure and the molded article. FIG. 1 is a perspective view of the terminal holding structure and the protector according to the embodiment. FIG. 2 is a plan view of a grounding terminal according to the embodiment. FIG. 3 is a side view of the grounding terminal according to the embodiment. FIG. 4 is a plan view of the terminal holding structure and the protector according to the embodiment. FIG. 5 is a sectional view of the terminal holding structure according to the embodiment. FIG. 6 is a sectional view of side walls according to the embodiment. FIG. 5 illustrates a section V-V of FIG. 4. FIG. 6 illustrates a section VI-VI of FIG. 5. FIG. 8 illustrates a section VIII-VIII of FIG. 7.

A protector 1 of the present embodiment illustrated in FIG. 1 is an example of the molded article, and is a protection member that protects a wire harness 20. The wire harness 20 is mounted, for example, on a vehicle, such as an automobile, and interconnects devices on the vehicle. The wire harness 20 includes a plurality of electric wires W used for power supply and signal communication. The wire harness 20 is routed along, for example, wall surfaces of component members constituting the vehicle. The wire harness 20 includes a grounding terminal 21 electrically connected to a vehicle body of the vehicle. The grounding terminal 21 is connected to a grounding wire W1 among the electric wires W constituting the wire harness 20.

The grounding terminal 21 is temporarily fixed by a terminal holding structure 40. The terminal holding structure 40 of the present embodiment includes a fixing wall portion 14, an arm portion 15 and supporting portions 18*a* and 18*b*. The protector 1 of the present embodiment includes the terminal holding structure 40 and a protecting portion 11. The following describes in detail the terminal holding structure 40 and the protector 1.

The protector 1 includes the protecting portion 11 that accommodates and protects the wire harness 20. The protecting portion 11 forms an accommodating space 12 having a substantially U-shaped sectional shape. The wire harness 20 is accommodated in the accommodating space 12. The protecting portion 11 includes a bottom wall 11*a*, a first side wall 11*b*, and a second side wall 11*c*. The bottom wall 11*a* and the side walls 11*b* and 11*c* are integrally molded of an insulating synthetic resin. The first side wall 11*b* and the second side wall 11*c* are connected to the bottom wall 11*a* at one end and the other end of the bottom wall 11*a* in the width direction thereof, respectively. The side walls 11*b* and 11*c* project toward a direction orthogonal to the bottom wall 11*a*, and face each other across the bottom wall 11*a*. The protecting portion 11 serves as a main body that is mounted on the wire harness 20. For example, a lid member is assembled with the protecting portion 11 in the state where the wire harness 20 is accommodated in the accommodating space 12. The lid member constitutes a tube in conjunction with the protecting portion 11, and protects the wire harness 20. The protecting portion 11 is mounted on the wire harness 20 by being assembled with the lid member. The method of mounting the protecting portion 11 on the wire harness 20 is not limited to the method using the lid member.

The protector 1 includes a flange portion 13. The flange portion 13 is integrally molded with the protecting portion 11. The flange portion 13 and the protecting portion 11 are preferably integrally molded of the same material. The flange portion 13 may, however, be molded of a different material from that of the protecting portion 11. The flange portion 13 is molded of a material providing flexibility to the arm portion 15 (to be described later), typically molded of an insulating synthetic resin. The flange portion 13 is connected to an outer side surface 11*d* of the first side wall 11*b*. More in detail, the flange portion 13 is connected to an end of the outer side surface 11*d* on a side opposite to the bottom wall 11*a*, and projects toward a side opposite to the second side wall 11*c*. The fixing wall portion 14 of the flange portion 13 is fixed, together with the grounding terminal 21, to a fixing target part 3 (refer to FIG. 12). The fixing wall portion 14 is provided with a through-hole 14*a*.

The grounding terminal 21 includes a main body 22, a crimp portion 23, and a projecting piece 24. The main body 22, the crimp portion 23, and the projecting piece 24 are integrally formed of an electrically conductive metal material. The grounding terminal 21 of the present embodiment is formed by, for example, press working to a metal plate of, for example, copper. The main body 22 is a flat plate-like constitutional part. A circular through-hole 22*a* is formed in the main body 22. The crimp portion 23 is crimped against the grounding wire W1. The main body 22 and the crimp portion 23 are connected together via a stepped portion 25. A step in the thickness direction of the grounding terminal 21 is formed at the stepped portion 25 between the main body 22 and the crimp portion 23.

The projecting piece 24 projects from the main body 22 toward a side opposite to the crimp portion 23. The main body 22 and the projecting piece 24 constitute an integral flat plate-like constitutional part. In the longitudinal direction of the grounding terminal 21, the crimp portion 23 side will be called the "proximal end side", and the projecting piece 24 side will be called the "distal end side". That is, the crimp portion 23 corresponds to a proximal end portion of the grounding terminal 21, and the projecting piece 24 corresponds to a distal end portion of the grounding terminal 21. The projecting piece 24 is formed into a tapered shape with a width reduced toward the distal end side. The distal end of the projecting piece 24 is provided with a locking portion 24*a*. The locking portion 24*a* is formed by bending the distal end of the projecting piece 24. More in detail, the distal end of the projecting piece 24 is bent toward a reverse face 21*b* side of the grounding terminal 21. The reverse face 21*b* of the grounding terminal 21 is a surface facing a wall surface of the fixing wall portion 14. An obverse face 21*a* of the grounding terminal 21 is a surface on the opposite side of the reverse face 21*b*, and is a surface on which a bolt 2 abuts when the grounding terminal 21 is fixed to the fixing target part 3 (refer to FIG. 12). The locking portion 24*a* is a flat plate-like constitutional part extending in a direction substantially orthogonal to the longitudinal direction of the grounding terminal 21.

The flange portion 13 of the protector 1 includes the arm portion 15, the supporting portions 18*a* and 18*b*, and side walls 19*a* and 19*b*. The arm portion 15 is integrally molded with the fixing wall portion 14. The arm portion 15 includes a flexible arm body 16 and a locking projection 17. The proximal end of the arm body 16 is connected to the fixing wall portion 14. As illustrated in FIG. 5, the arm body 16 is supported like a cantilever by the fixing wall portion 14. The arm body 16 extends in a direction along a wall surface 14*b* of the fixing wall portion 14. The arm body 16 is a columnar or plate-like constitutional part, with, for example, a sectional shape and a length set so as to have flexibility.

As illustrated in FIG. 5, the arm body 16 has a thickness smaller than that of the fixing wall portion 14. This difference in thickness forms a step 14*c* between the proximal end of the arm body 16 and the wall surface 14*b* of the fixing wall portion 14. The depth of the step 14*c* is equal to or slightly greater than the length of the locking portion 24*a*. The wall surface 14*b* is a wall surface in the fixing wall portion 14 that faces the grounding terminal 21.

As illustrated in FIGS. 1 and 5, the side walls 19*a* and 19*b* project from the wall surface 14*b* of the fixing wall portion 14. As illustrated in FIG. 6, the side walls 19*a* and 19*b* face each other in the width direction of the arm portion 15 across the arm portion 15. As illustrated in FIG. 1, each of the supporting portions 18*a* and 18*b* projects from corresponding one of the side walls 19*a* and 19*b* toward the other of the side walls 19*a* and 19*b*. That is, the supporting portion 18*a* connected to the side wall 19*a* projects toward the side wall 19*b* on the other side thereof whereas the supporting portion 18*b* connected to the side wall 19*b* projects toward the side wall 19*a* on the other side thereof. Each of the supporting portions 18*a* and 18*b* has a supporting surface 18*d* for supporting the grounding terminal 21. The supporting portions 18*a* and 18*b* of the present embodiment are provided in the same height position with respect to the fixing wall portion 14. That is, the supporting surfaces 18*d* are located in the same plane.

The supporting portions 18*a* and 18*b* form a passage 13*a* into which the grounding terminal 21 is slidingly inserted between the arm portion 15 and the supporting portions 18*a* and 18*b*. More in detail, the passage 13*a* is surrounded by the supporting portions 18*a* and 18*b*, the side walls 19*a* and 19*b*, and the arm body 16. The passage 13*a* is open toward the through-hole 14*a*. As illustrated in FIG. 6, the side walls 19*a* and 19*b* are arranged such that a center line X1 in the width direction of the passage 13*a* passes through a center C1 of the through-hole 14*a*. In the present embodiment, insertion of the projecting piece 24 of the grounding terminal 21 into the passage 13*a* positions the through-hole 22*a* into the through-hole 14*a*. As will be described later, when the projecting piece 24 has been inserted into the passage 13*a* and locked at the arm portion 15, the through-hole 22*a* of the grounding terminal 21 is positioned concentric or substantially concentric to the through-hole 14*a* of the fixing wall portion 14.

As illustrated in FIG. 5, the locking projection 17 of the arm portion 15 projects from the arm body 16 toward the supporting surface 18*d*. The locking projection 17 is provided at a location slightly offset toward the proximal end side of the distal end of the arm body 16. The locking projection 17 has a trapezoidal sectional shape along the extending direction of the arm body 16. In the following description, unless otherwise specified, the "extending direction" refers to the extending direction of the arm body 16. The locking projection 17 has a locking surface 17*a* and an inclined surface 17*b*. The locking surface 17*a* is a surface orthogonal or substantially orthogonal to the extending direction. The locking surface 17*a* is a surface on the distal end side in the extending direction of the locking projection 17. The inclined surface 17*b* is a surface on the proximal end side in the extending direction of the locking projection 17. The inclined surface 17*b* is inclined such that the amount of projection from the arm body 16 increases toward the distal end side in the extending direction. In other words, the inclined surface 17*b* is inclined so as to be closer to the supporting surface 18*d* toward the distal end side in the extending direction.

As illustrated in FIG. 1, the grounding terminal 21 is inserted into the passage 13*a* from the through-hole 14*a* side. The grounding terminal 21 is inserted into the passage 13*a* with the projecting piece 24 in front and in an attitude in which the reverse face 21*b* faces the wall surface 14*b* of the fixing wall portion 14. As illustrated in FIG. 7, the clearance between the supporting portions 18*a* and 18*b* decreases toward the distal end side in the extending direction. A width Wd1 of the clearance between the supporting portions 18*a* and 18*b* at an end on the proximal end side thereof is greater than a width Wd2 of the distal end of the projecting piece 24. Consequently, as illustrated in FIG. 8, the locking portion 24*a* of the grounding terminal 21 can be inserted into the step 14*c*. A width Wd3 between the supporting portions 18*a* and 18*b* at an end on the distal end side thereof (refer to FIG. 7) is set so as to be capable of supporting the projecting piece 24. At least when the locking portion 24*a* is in contact with the locking projection 17 (refer to FIG. 9), the supporting portions 18*a* and 18*b* face the obverse face 21*a* of the projecting piece 24, and support the projecting piece 24.

As illustrated in FIG. 8, a height H1 of the passage 13*a* is greater than a length L1 of the locking portion 24*a*. The height H1 of the passage 13*a* is a height of a space ranging from the supporting surface 18*d* to the arm body 16. The length L1 of the locking portion 24*a* is a length from the obverse face 21*a* of the grounding terminal 21 to a distal end 24*b* of the locking portion 24*a*. The supporting surface 18*d* is disposed so as to provide a clearance corresponding to the thickness of the grounding terminal 21 between the wall surface 14*b* of the fixing wall portion 14 and the supporting surface 18*d*. Consequently, an operator can easily insert the grounding terminal 21 into the passage 13*a*.

As illustrated in FIG. 8, the locking projection 17 of the arm portion 15 projects into a passing region P1 of the grounding terminal 21 inserted into the passage 13*a*. The passing region P1 is a passing region of the grounding terminal 21 when the grounding terminal 21 is inserted into the passage 13*a* while sliding the reverse face 21*b* along the wall surface 14*b* of the fixing wall portion 14. The height of the passing region P1 corresponds to the length L1 of the locking portion 24*a*. In the present embodiment, the amount of projection of the locking projection 17 into the passing region P1 is roughly from one quarter to one third of the height of the passing region P1. In this manner, the locking projection 17 projects into a position that comes in contact with the locking portion 24*a* of the grounding terminal 21 when the grounding terminal 21 is pushed toward the distal end side in the extending direction.

Figure 9:
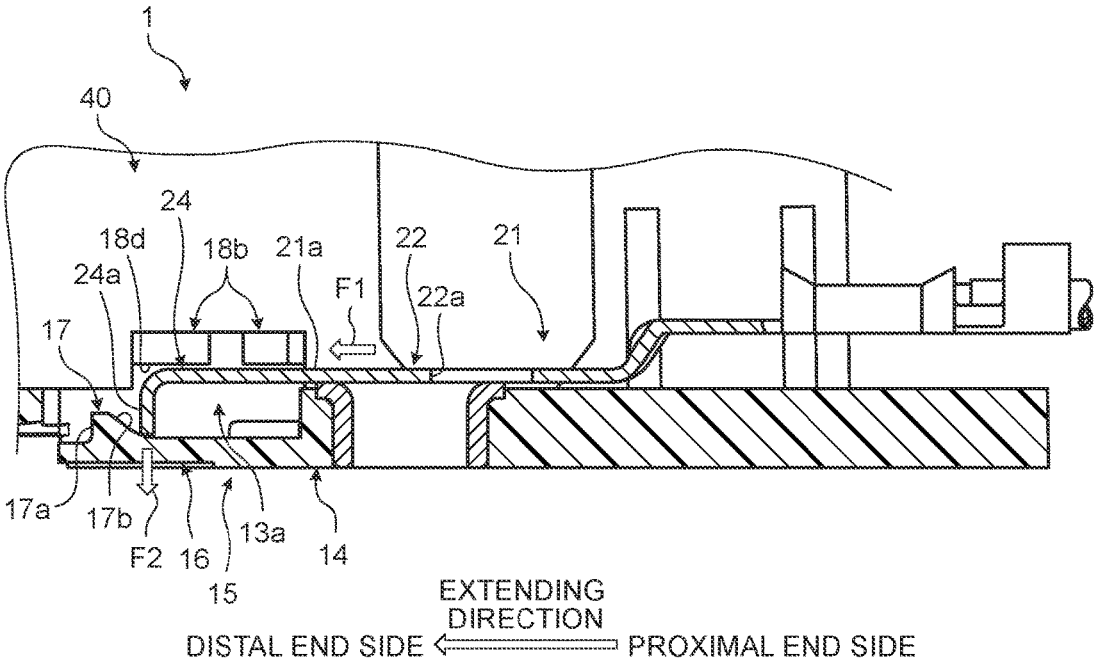
FIG. 9 is a sectional view of a state where the grounding terminal has come in contact with a locking projection.

After the grounding terminal 21 further advances from the position indicated in FIG. 8 toward the distal end side in the extending direction, the locking portion 24*a* comes in contact with the inclined surface 17*b* of the arm portion 15, as illustrated in FIG. 9. Force F1 moving the grounding terminal 21 toward the distal end thereof causes force F2 bending the arm body 16 to be applied to the arm portion 15. The projecting piece 24 bends the arm body 16 while being supported by the supporting surface 18*d* of the supporting portion 18*b*. Although not illustrated in FIG. 9, the supporting surface 18*d* of the supporting portion 18*a* also supports the projecting piece 24 in the same manner. The locking portion 24*a* of the projecting piece 24 moves over the locking projection 17 while bending the arm portion 15.

Figure 10:
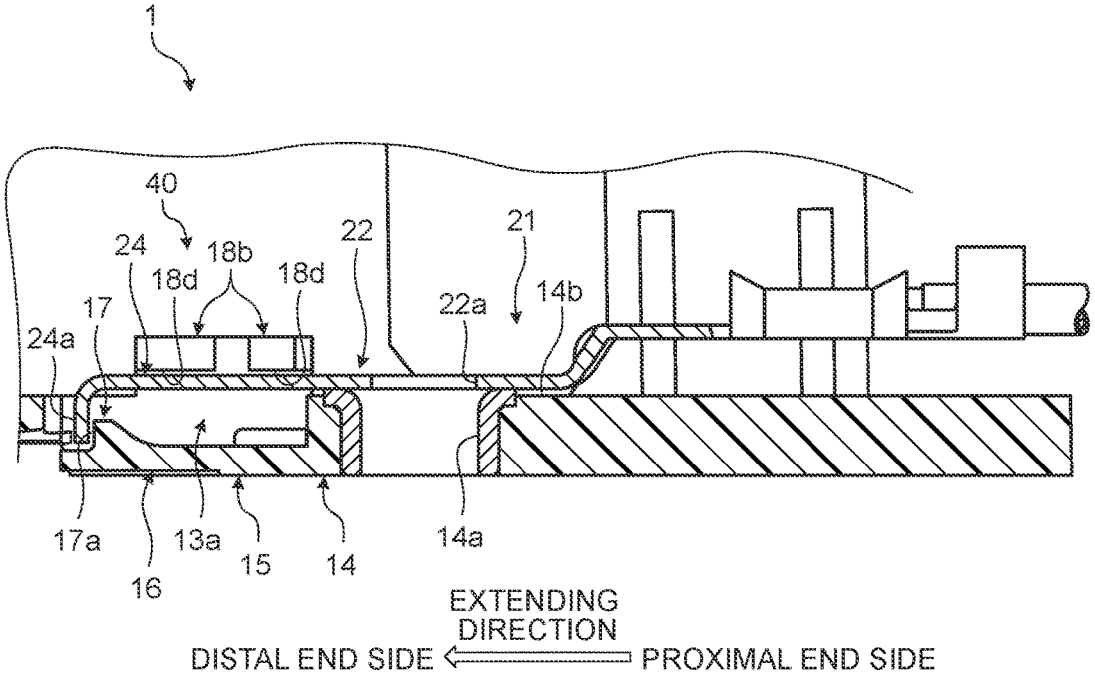
FIG. 10 is a sectional view of a state where the locking projection has locked a locking portion.

After the locking portion 24*a* moves over the locking projection 17, the locking projection 17 locks the locking portion 24*a*, as illustrated in FIG. 10. The locking surface 17*a* of the locking projection 17 faces the locking portion 24*a* in the extending direction. The locking surface 17*a* restricts the grounding terminal 21 from moving toward the proximal end side in the extending direction. That is, the arm portion 15 locking the locking portion 24*a* serves as a retainer for the grounding terminal 21. The supporting portions 18*a* and 18*b* support the projecting piece 24 of the grounding terminal 21 from a side thereof opposite to the arm portion 15 side. That is, the supporting portions 18*a* and 18*b* restrict the grounding terminal 21 from lifting in a direction departing from the arm portion 15.

Figure 11:
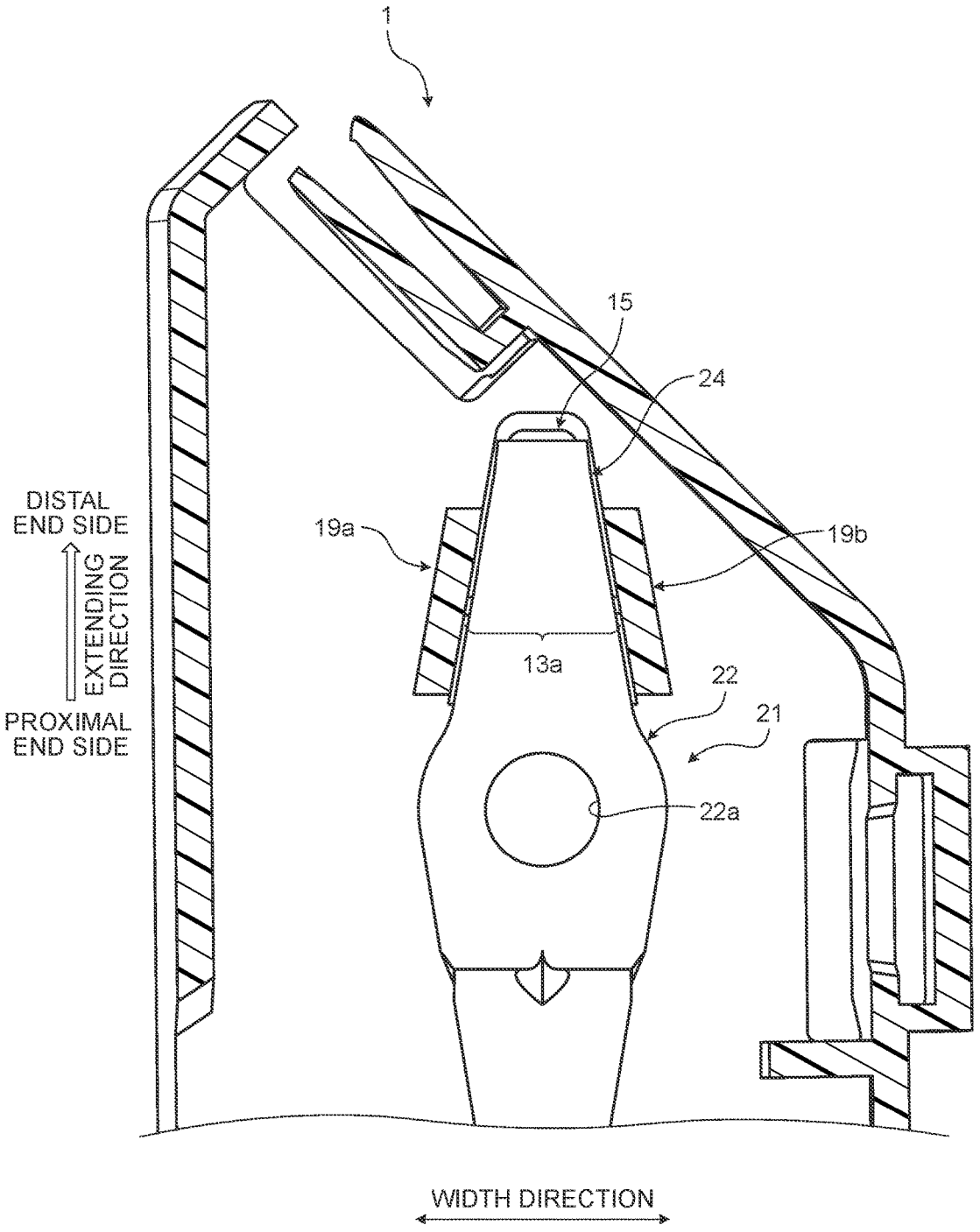
FIG. 11 is a sectional view for explaining working of the side walls.

In this manner, the locking projection 17 of the arm portion 15 restricts the movement of the grounding terminal 21 toward the proximal end side in the extending direction. The supporting portions 18*a* and 18*b* restrict the grounding terminal 21 from moving toward a direction orthogonal to the wall surface 14*b* of the fixing wall portion 14. As will be described later with reference to FIG. 11, the side walls 19*a* and 19*b* restrict the grounding terminal 21 from moving toward the distal end side in the extending direction. As illustrated in FIG. 11, the clearance between the side walls 19*a* and 19*b* decreases toward the distal end side in the extending direction. Consequently, the clearance between each of the side walls 19*a* and 19*b* and the projecting piece 24 decreases as the projecting piece 24 advances toward the farther side of the passage 13*a*. The side walls 19*a* and 19*b* are formed so as to have a small clearance from the projecting piece 24 in a state where the locking projection 17 locks the locking portion 24*a* (hereinafter, simply called the "locking state"), as illustrated in FIGS. 10 and 11. This configuration causes the side walls 19*a* and 19*b* to restrict the projecting piece 24 from moving from the locking state toward the distal end side. The side walls 19*a* and 19*b* restrict the projecting piece 24 from moving in the width direction thereof, and thus serve as rotation stoppers for the grounding terminal 21.

Figure 12:
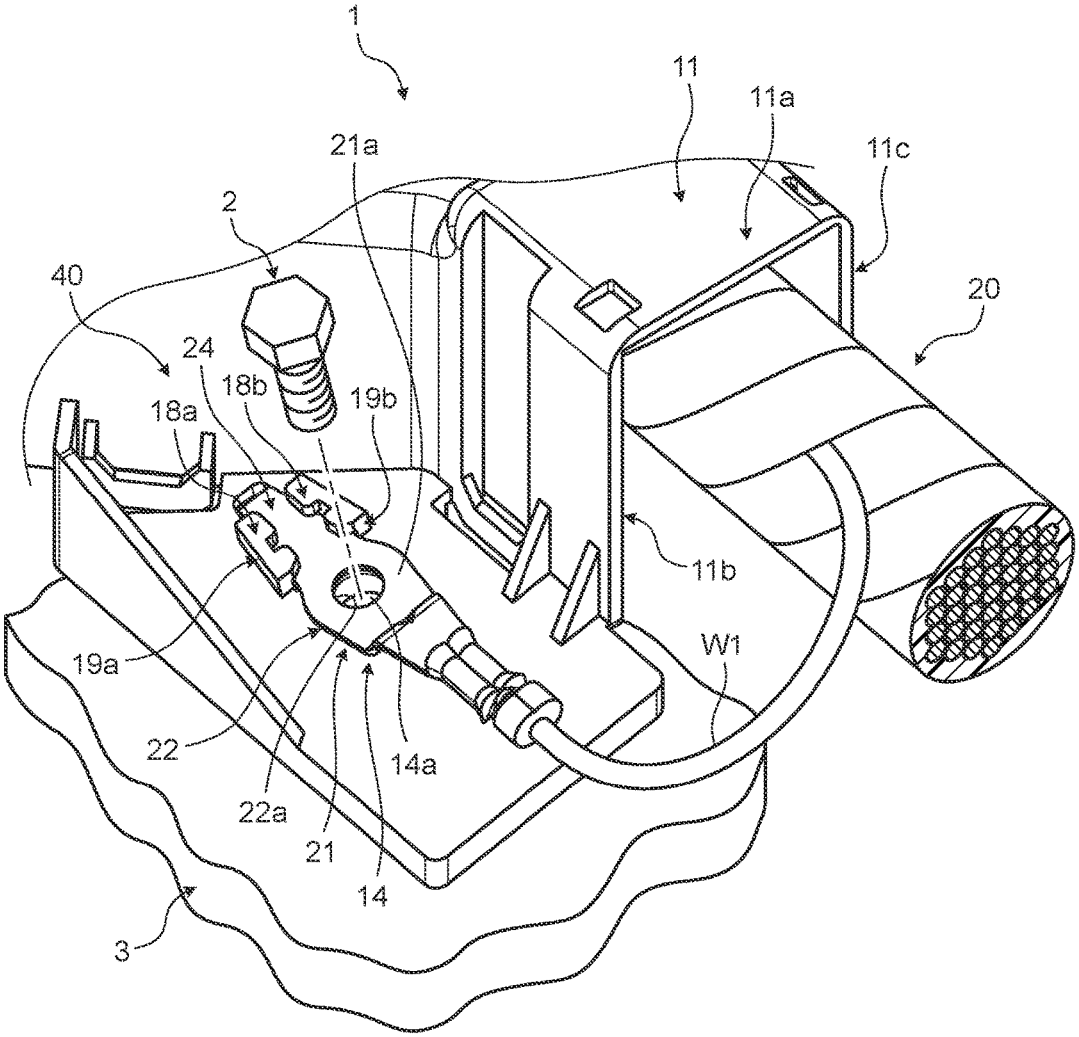
FIG. 12 is a perspective view for explaining fixing to a fixing target part.

The locking projection 17 locks the locking portion 24*a* as described above, whereby the grounding terminal 21 is temporarily fixed to the protector 1. The protector 1 is transferred to a process of assembly to the vehicle, in the state where the wire harness 20 is accommodated in the accommodating space 12 and the grounding terminal 21 is temporarily fixed. As illustrated in FIG. 12, the fixing wall portion 14 of the protector 1 is fixed, together with the grounding terminal 21, to the fixing target part 3 by the bolt 2. The bolt 2 is an example of a fixing member. The fixing target part 3 is, for example, the vehicle body of the vehicle. The fixing target part 3 is provided with a threaded hole corresponding to the bolt 2. The fixing wall portion 14 is fastened together with the grounding terminal 21 to the fixing target part 3. The fixing target part 3 may be provided with a stud bolt that is inserted into the through-holes 14*a* and 22*a*. In this case, a nut is fastened to the stud bolt to jointly fasten the grounding terminal 21 and the fixing wall portion 14.

Figure 13:
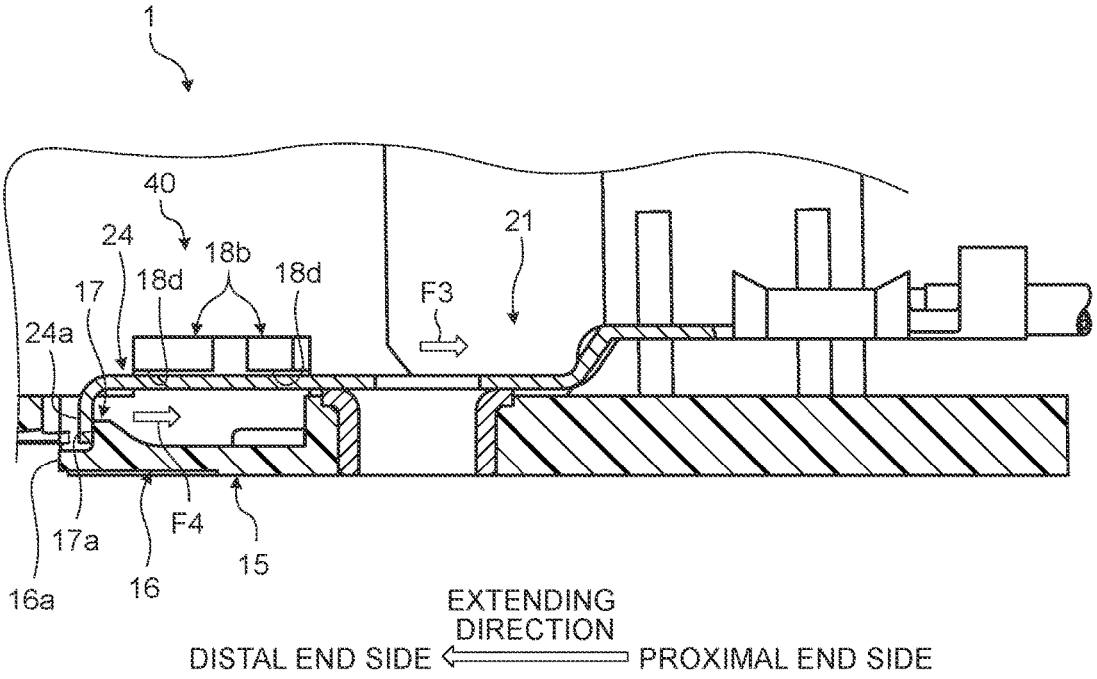
FIG. 13 is a sectional view for explaining a holding performance of the terminal holding structure.

When the protector 1 is transferred, force in a direction of pulling out the grounding terminal 21 may be applied thereto because, for example, another component or the like is caught on the grounding wire W1. In this case, as will be described with reference to FIG. 13, force acts in a direction in which the locking portion 24*a* of the grounding terminal 21 bites into the locking projection 17. As illustrated in FIG. 13, application of force F3 toward the proximal end side to the grounding terminal 21 causes the locking portion 24*a* to press the locking surface 17*a* of the locking projection 17 toward the proximal end side. This force F4 is force along the extending direction of the arm portion 15. The arm portion 15 can generate large resistive force against the compressive force F4 along the extending direction. The maximum value of the resistive force that can be generated by the arm portion 15 to resist to the force F4 is sufficiently larger than force to bend the arm portion 15 when the grounding terminal 21 is inserted. Consequently, the terminal holding structure 40 of the present embodiment is capable of both improving the holding performance and improving the workability in making the grounding terminal retained.

If the force F4 pulls up the arm portion 15 together with the grounding terminal 21 toward the supporting portions 18*a* and 18*b*, the supporting portions 18*a* and 18*b* restricts this movement. That is, the arm portion 15 is restricted from bending toward the supporting portions 18*a* and 18*b*. As a result, the locking of the locking projection 17 to the locking portion 24*a* is restrained from being released.

In this manner, when the projecting piece 24 advances toward the distal end side in the extending direction, the arm portion 15 is easily bent and locked to the locking portion 24*a* of the projecting piece 24. After the locking projection 17 is locked to the locking portion 24*a*, the supporting portions 18*a* and 18*b* restricts the arm portion 15 from bending in the direction of releasing the locking state. Consequently, the terminal holding structure 40 of the present embodiment allows the grounding terminal 21 to be easily temporarily fixed to the protector 1 with small force. The terminal holding structure 40 firmly retains the temporarily fixed grounding terminal 21, and restrains the grounding terminal 21 from being unintentionally pulled out or dislocated.

To remove the temporarily fixed grounding terminal 21, the locking state can be easily canceled by merely pushing down a distal end 16*a* of the arm body 16 using a tool, such as a small screwdriver, or a jig. If the tool, the jig, or other device is used to bend the arm body 16 toward a side opposite to the supporting portions 18*a* and 18*b*, the locking by the locking projection 17 is released, and the grounding terminal 21 is easily pulled out. That is, the grounding terminal 21 is easily removable from the protector 1 at any time. The terminal holding structure 40 of the present embodiment may be applied to the grounding terminal 21 that is removed from the temporary fixing position and fixed to, for example, the vehicle body, in other words, to the grounding terminal 21 that is fixed to, for example, the vehicle body separately from the fixing wall portion 14. Accordingly, the terminal holding structure 40 of the present embodiment is applicable to combinations of various types of the protector 1 with the grounding terminal 21.

As described above, the terminal holding structure 40 according to the present embodiment includes the fixing wall portion 14, the arm portion 15, and the supporting portions 18*a* and 18*b*. The fixing wall portion 14 is fixed, together with the grounding terminal 21, to the fixing target part 3 by the fixing member, such as the bolt 2. The flexible arm portion 15 is connected, at the proximal end thereof, to the fixing wall portion 14, extends in the direction along the wall surface 14*b* of the fixing wall portion 14, and locks the locking portion 24*a* provided at the distal end portion of the grounding terminal 21. The supporting portions 18*a* and 18*b* form, in conjunction with the arm portion 15, the passage 13*a* into which the grounding terminal 21 is inserted by being slid thereon along the arm portion 15. The supporting portions 18*a* and 18*b* support the grounding terminal 21 from the side thereof opposite to the arm portion 15 side in a state where the arm portion 15 locks the locking portion 24*a*.

In the terminal holding structure 40 of the present embodiment, the arm portion 15 has flexibility. This allows the operator to slide the grounding terminal 21 while making the arm portion 15 bent by the grounding terminal 21, and to lock the arm portion 15 to the locking portion 24*a* of the grounding terminal 21. The arm portion 15 locked to the locking portion 24*a* retains the grounding terminal 21 by generating the resistive force large enough to resist to the force in the direction of coming out of the grounding terminal 21. The arm portion 15 is relatively easily deformed by bending force, but is difficult to be deformed by force in the extending direction. Consequently, the terminal holding structure 40 of the present embodiment is capable of both improving the holding performance and improving the workability in making the grounding terminal 21 retained.

The supporting portions 18*a* and 18*b* of the present embodiment support the grounding terminal 21 from the side thereof opposite to the arm portion 15 side. When the grounding terminal 21 is going to come out, the supporting portions 18*a* and 18*b* nip the grounding terminal 21 in conjunction with the arm portion 15 to support the grounding terminal 21, and thus restrain the grounding terminal 21 from coming out. Consequently, the supporting portions 18*a* and 18*b* improve the holding performance for holding the grounding terminal 21. The supporting portions 18*a* and 18*b* support the flat plate-like portion, typically support the projecting piece 24, of the grounding terminal 21. This configuration can keep the height of the side walls 19*a* and 19*b* smaller. As a comparative example, assume a configuration in which the supporting portions 18*a* and 18*b* and the side walls 19*a* and 19*b* retain the crimp portion 23 of the grounding terminal 21. In this case, since the crimp portion 23 is likely to vary in height, the side walls 19*a* and 19*b* need to have a large height. As a result, clearances are likely to be generated at holding portions. In contrast, the flat plate-like portion of the grounding terminal 21 has stable dimensions. Consequently, in the terminal holding structure 40 of the present embodiment, the side walls 19*a* and 19*b* can have a smaller height to sufficiently reduce clearances between the grounding terminal 21 and the supporting portions 18*a* and 18*b*.

The arm portion 15 extends from the fixing wall portion 14 in the direction along the wall surface 14*b* of the fixing wall portion 14. Since the arm portion 15 of the present embodiment extends in the direction along the wall surface 14*b*, the arm portion 15 is more difficult to interfere with other components than, for example, a locking arm projecting from the wall surface 14*b*. Consequently, the arm portion 15 is hardly damaged by the interference with the other components. Furthermore, in the terminal holding structure 40 of the present embodiment, the supporting portions 18*a* and 18*b* guard the arm portion 15. The supporting portions 18*a* and 18*b* are disposed so as to face the arm portion 15 in the thickness direction of the fixing wall portion 14. Consequently, the arm portion 15 is difficult to interfere with the other components.

The arm portion 15 of the present embodiment includes the flexible arm body 16 and the locking projection 17 that projects from the arm body 16 toward the supporting portions 18*a* and 18*b* and locks the locking portion 24*a*. The locking projection 17 projects into the passing region P1 of the grounding terminal 21 inserted into the passage 13*a*. Consequently, when the grounding terminal 21 is inserted into the passage 13*a*, the grounding terminal 21 abuts on the locking projection 17, and bends the arm portion 15. After the locking projection 17 locks the locking portion 24*a*, the locking projection 17 abuts on the locking portion 24*a* to restrain the grounding terminal 21 from coming out.

In the present embodiment, the locking portion 24*a* is a projection projecting toward the arm portion 15, and the locking projection 17 projects into the passing region P1 of the locking portion 24*a*. That is, the locking portion 24*a* is configured to abut on the locking projection 17 and bend the arm portion 15 when the grounding terminal 21 is inserted into the passage 13*a*. The inclined surface 17*b* of the locking projection 17 is provided so as to face the locking portion 24*a* in the extending direction. Consequently, the locking portion 24*a* can smoothly get over the locking projection 17.

The terminal holding structure 40 of the present embodiment includes the pair of side walls 19*a* and 19*b* that project from the wall surface 14*b* of the fixing wall portion 14, and that face each other in the width direction of the arm portion 15 across the arm portion 15. Each of the supporting portions 18*a* and 18*b* projects from corresponding one of the side walls 19*a* and 19*b* toward the other of the side walls 19*a* and 19*b*. Since the side walls 19*a* and 19*b* are integrated with the supporting portions 18*a* and 18*b*, the grounding terminal 21 is appropriately guided when being inserted into the passage 13*a*.

The protector 1 of the present embodiment includes the protecting portion 11, the fixing wall portion 14 integrally molded with the protecting portion 11, the arm portion 15, and the supporting portions 18*a* and 18*b*. In the protector 1 that is the molded article, the protecting portion 11 serves as the main body that is mounted on the wire harness 20. The protector 1 having the terminal holding structure 40 including the arm portion 15 and the supporting portions 18*a* and 18*b* is capable of both improving the holding performance and improving the workability in making the grounding terminal 21 retained.

Modifications of Embodiment

Modifications of the embodiment will be described below. In the embodiment described above, the supporting portions 18*a* and 18*b* are integrated with the side walls 19*a* and 19*b*. The supporting portions 18*a* and 18*b* may, however, be provided separately from the side walls 19*a* and 19*b*. For example, the supporting portions 18*a* and 18*b* may project from the outer side surface 11*d* of the first side wall 11*b*. In the embodiment described above, the width of the clearance between the side walls 19*a* and 19*b* decreases toward the distal end side in the extending direction. The width may, however, be constant along the extending direction. The width of the clearance between the side walls 19*a* and 19*b* is appropriately set according to the shape of the grounding terminal 21 to be fixed.

In the embodiment described above, the locking portion 24*a* is the projection provided at the projecting piece 24. However, the locking portion 24*a* is not limited to having such a shape. The locking portion 24*a* may be, for example, a recess or a through-hole provided at the projecting piece 24. In this case, the locking projection 17 of the arm portion 15 enters the recess or the through-hole of the projecting piece 24 to lock the locking portion 24*a*.

In the embodiment described above, the supporting portions 18*a* and 18*b* are provided at both the pair of side walls 19*a* and 19*b*. Instead, the supporting portion 18*a* or 18*b* may be provided at either one of the side walls 19*a* and 19*b*. For example, a configuration may be employed in which the supporting portion 18*a* is provided at the side wall 19*a* on one side, and the supporting portion 18*b* is not provided at the side wall 19*b* on the other side.

The molded article to which the terminal holding structure 40 is applied is not limited to the protector 1. The terminal holding structure 40 may be applied to, for example, electric junction boxes, such as connector blocks and relay boxes. The terminal holding structure 40 is applicable to various molded articles mounted on the wire harness 20 and various molded articles constituting the wire harness 20. The material of the molded article is typically a synthetic resin, but is not limited thereto. The molded article may be mounted on the wire harness 20, for example, by fitting a terminal connected to the electric wires W to the molded article.

The content disclosed in the embodiment and the modifications thereof described above may be carried out in appropriate combinations thereof.

A terminal holding structure and a molded article according to the present invention each include a fixing wall portion configured to be fixed, together with a grounding terminal, to a fixing target part by a fixing member; a flexible arm portion that is connected, at a proximal end thereof, to the fixing wall portion, and extends in a direction along a wall surface of the fixing wall portion, and that is configured to lock a locking portion provided at a distal end portion of the grounding terminal; and a supporting portion that forms, in conjunction with the arm portion, a passage into which the grounding terminal is inserted by being slid thereon along the arm portion, and that is configured to support the grounding terminal from a side thereof opposite to the arm portion side in a state where the arm portion locks the locking portion.

In the terminal holding structure and the molded article according to the embodiments, when the grounding terminal is inserted while sliding along the arm portion, the arm portion bends. As a result, the force required to lock the arm portion to the locking portion is reduced. The force in the direction in which the grounding terminal is going to come out is force along the extending direction of the arm portion. The arm portion generates large resistive force against the force along the extending direction, and locks the locking portion so as to prevent the grounding terminal from coming out. As a result, the terminal holding structure and the molded article according to the present invention provide the effect that improvements are obtained both in the holding performance and in the workability in making the grounding terminal retained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal holding structure comprising:

a fixing wall portion configured to be fixed, together with a grounding terminal, to a fixing target part by a fixing member;

an arm portion that is flexible and connected, at a proximal end thereof, to the fixing wall portion, and extends in a direction along a wall surface of the fixing wall portion, and that is configured to bend and lock a locking portion provided at a distal end portion of the grounding terminal in a state where the grounding terminal passes from the proximal end of the arm portion to a distal end of the arm portion; and a supporting portion that forms, in conjunction with the arm portion, a passage into which the grounding terminal is inserted by being slid thereon along the arm portion, and that is configured to support the grounding terminal from a side thereof opposite to a side of the arm portion in a state where the arm portion locks the locking portion, wherein the wall surface of the fixing wall portion opposes the supporting portion, and the arm portion is recessed below the wall surface of the fixing wall portion.

2. The terminal holding structure according to claim 1, wherein the arm portion includes a flexible arm body, and a locking projection that projects from the arm body toward a side of the supporting portion and that is configured to lock the locking portion, and the locking projection projects into a passing region of the grounding terminal inserted into the passage.

3. The terminal holding structure according to claim 2, further comprising:

a pair of side walls that project from the wall surface of the fixing wall portion, and that face each other in a width direction of the arm portion across the arm portion, wherein the supporting portion projects from one of the side walls toward the other of the side walls.

4. The terminal holding structure according to claim 1, further comprising:

a pair of side walls that project from the wall surface of the fixing wall portion, and that face each other in a width direction of the arm portion across the arm portion, wherein the supporting portion projects from one of the side walls toward the other of the side walls.

5. The terminal holding structure according to claim 1, wherein the supporting portion includes a first supporting portion and a second supporting portion opposing and spaced apart from the first supporting portion, each of the first and second supporting portions includes a distal end and a proximal end, and a clearance between the proximal ends of the first and second supporting portions has a first width, and the grounding terminal has a second width at the distal end thereof that is less than the first width.

6. The terminal holding structure according to claim 5, wherein a clearance between the distal ends of the first and second supporting portions has a third width that is less than each of the first width and the second width.

7. The terminal holding structure according to claim 1, further comprising:

a step formed between the end of the arm portion and the wall surface of the fixing wall portion.

8. The terminal holding structure according to claim 1, wherein the arm portion has a thickness smaller than that of the fixing wall portion such that the arm portion bends relative to the fixing wall portion in a state where the grounding terminal passes from the proximal end of the arm portion to a distal end of the arm portion.

9. A molded article comprising:

a main body configured to be mounted on a wire harness, and the main body includes an accommodation space into which the wire harness extends when the main body is mounted on the wire harness;

a fixing wall portion that is molded integrally with the main body, and that is configured to be fixed, together with a grounding terminal of the wire harness, to a fixing target part by a fixing member;

a arm portion that is flexible and connected, at a proximal end thereof, to the fixing wall portion, and extends in a direction along a wall surface of the fixing wall portion, and that is configured to lock a locking portion provided at a distal end portion of the grounding terminal; and a supporting portion that forms, in conjunction with the arm portion, a passage into which the grounding terminal is inserted by being slid thereon along the arm portion, and that is configured to support the grounding terminal from a side thereof opposite to a side of the arm portion in a state where the arm portion locks the locking portion.

* * * * *